US005279249A

United States Patent [19]

Pepper

[11] Patent Number: 5,279,249

[45] Date of Patent: Jan. 18, 1994

[54] BOAT CONSTRUCTION

[75] Inventor: Geoffrey T. Pepper, Lebanon, Mo.

[73] Assignee: Outboard Marine Corporation, Waukegan, Ill.

[21] Appl. No.: 975,101

[22] Filed: Nov. 12, 1992

Related U.S. Application Data

[63] Continuation-in-part of Ser. No. 814,348, Dec. 27, 1991, abandoned.

[51] Int. Cl.[5] ..... B63B 5/24

[52] U.S. Cl. ..... 114/356; 114/355

[58] Field of Search ..... 114/355, 356, 65

[56] References Cited

U.S. PATENT DOCUMENTS

| | | | |
|---|---|---|---|
| D. 243,445 | 2/1977 | Khoury | D12/62 |
| D. 245,409 | 8/1977 | Bostic et al. | D12/62 |
| D. 245,902 | 9/1977 | Rogers | D12/62 |
| D. 251,834 | 5/1979 | Wood | D12/62 |
| D. 252,507 | 7/1979 | Wood | D12/62 |
| D. 259,480 | 6/1981 | Bednar | D12/318 |
| D. 261,128 | 10/1981 | Fowler | D12/300 |
| D. 262,009 | 11/1981 | Bednar | D12/300 |
| D. 264,573 | 5/1982 | Rogers | D12/310 |
| D. 291,685 | 9/1987 | Wood et al. | D12/314 |
| D. 301,711 | 6/1989 | Allbritton | D12/314 |
| 1,761,451 | 6/1930 | Ohnstrand | 114/356 |
| 1,790,624 | 1/1931 | Shoup | 114/356 |
| 2,185,555 | 1/1940 | Johnson | 114/356 |
| 2,515,161 | 7/1950 | Hall | 114/356 |
| 2,743,694 | 5/1956 | McAleer | 114/79 |
| 2,821,989 | 2/1958 | Shepard | 135/6 |
| 2,999,254 | 9/1961 | Nolde | 114/356 |
| 3,065,724 | 11/1962 | Tritt | 114/88 |
| 3,179,961 | 4/1965 | Ward et al. | 114/356 |
| 3,241,162 | 3/1966 | Wiplinger | 114/356 |
| 3,246,349 | 4/1966 | Lyon | 114/84 |
| 3,298,343 | 1/1967 | Juhnke | 114/356 |
| 4,365,580 | 12/1982 | Blount | 114/356 |
| 4,683,900 | 8/1987 | Carmichael | 135/88 |
| 4,744,320 | 5/1988 | Johnston | 114/356 |
| 4,827,862 | 5/1989 | Enriquez | 114/273 |
| 4,924,797 | 5/1990 | Solia | 114/288 |
| 5,086,725 | 2/1992 | Garrett et al. | 114/356 |

FOREIGN PATENT DOCUMENTS 8612 of 1894 United Kingdom ..... 114/356

OTHER PUBLICATIONS

Oct. 1991, *Hurricane* brochure by Godfrey Marine.
Sep. 1990 *Sea Nymph* catalogue.
Dec. 1988 *Lowe Aluminum Boats* catalogue.
Thompson Catalog, 1988, Thompson Boat Company, St. Charles, MI.

*Primary Examiner*—David M. Mitchell
*Assistant Examiner*—Stephen P. Avila
*Attorney, Agent, or Firm*—Michael, Best & Friedrich

[57] ABSTRACT

A recreational boat comprising first and second sheets of aluminum having respective first and second longitudinal edges, the first sheet having a first bend extending along a majority of the length of the first sheet between the first and second longitudinal edges of the first sheet, the second sheet having a second bend extending along a majority of the length of the second sheet between the first and second longitudinal edges of the second sheet, the first sheet and the second sheet affixed along the respective first longitudinal edges to form a centerline of the boat, a plurality of transverse ribs affixed to the first and the second sheets, first and second inboard vertical walls, and first and second narrow side decks each having an outer edge portion and an inner edge portion, the first narrow deck outer edge portion affixed to the second longitudinal edge of the first sheet and the first narrow deck inner edge portion affixed to the top of the first vertical wall, the second narrow deck outer edge portion affixed to the second longitudinal edge of the second aluminum sheet and the second narrow deck inner edge portion affixed to the top of the second vertical wall, and the bottoms of the first and second vertical walls respectively affixed to the transverse ribs inboard of the respective first and second bends.

28 Claims, 6 Drawing Sheets

BOAT CONSTRUCTION

RELATED APPLICATION

This is a continuation-in-part of U.S. Ser. No. 814,348, filed Dec. 27, 1991 now abandoned.

FIELD OF THE INVENTION

This patent relates to an aluminum boat construction, especially a boat that is relatively rigid, yet open on the top or deck and cockpit area.

BACKGROUND OF THE INVENTION

Attention is directed to U.S. Pat. No. Des. 262,009 and U.S. Pat. No. Des. 259,480 for examples of fiberglass constructed deck boats, or boats with a relatively open deck or cockpit area made with a fiberglass hull.

In addition, attention is directed to the 1991 Godfrey Hurricane Catalog which discloses another example of a fiberglass hulled deck boat.

Additionally, attention is directed to the 1988 Lowe Aluminum Boats Catalogue and the 1990 Sea Nymph Catalogue, both of which show examples of recreational boats made of aluminum material.

SUMMARY OF THE INVENTION

The invention includes a recreational boat having first and second sides and comprising a first sheet of aluminum having first and second longitudinal edges and a first bend extending along a majority of the length of the sheet between the first and second longitudinal edges, the first bend forming a first chine of the boat, a second sheet of aluminum also having first and second longitudinal edges and a second bend extending along a majority of the length of the sheet between the first and second longitudinal edges, the second bend forming a second chine of the boat, a plurality of transverse ribs, with each of said ribs affixed to the first and second sheets, first and second narrow side decks, each of the narrow side decks having an outer edge portion and an inner portion, and first and second inboard vertical walls, with each of the vertical walls having a top and a bottom. The first sheet and the second sheet are affixed along their respective first longitudinal edges to form a centerline of the boat. The first narrow deck outer edge portion is affixed to the second longitudinal edge of the first aluminum sheet and the first narrow deck inner edge portion is affixed to the top of the first vertical wall, the second narrow deck outer portion is affixed to the second longitudinal edge of the second aluminum sheet and the second narrow deck inner edge portion is affixed to the top of the second vertical wall. The bottoms of the first and second vertical walls are respectively attached to the ribs inboard of the respective first and second bends.

In a preferred embodiment, the first sheet, first narrow side deck and the first vertical wall comprise a first box section along the one side of the boat and the second sheet, second narrow deck and second vertical wall comprise a second box section along the second side of the boat and the first and second box sections enhance the rigidity of the boat.

In one embodiment, the first longitudinal edge of the first sheet has a first depending lip along a majority of its length and the first longitudinal edge of the second sheet has a second depending lip along a majority of its length and the first sheet and the second sheet are affixed along the first and second lips to form a keel of the boat.

In another embodiment, the first sheet also comprises a first longitudinal slit at its forward portion with a slit between the first and second longitudinal edges and forward of the first bend. The first sheet has a pair of edges along the first slit and the edges are welded together.

In one embodiment, the boat further includes a cockpit floor extending between the first and second vertical walls and below the first and second narrow decks. The cockpit floor is supported by a plurality of transverse floor supports and longitudinal floor supports with the transverse floor supports also attached to the vertical walls.

In another embodiment, the boat also has floatation material substantially filling the space outboard of the first and second vertical walls and below the first and second narrow decks.

In one embodiment, the first and second aluminum sheets also have aft edges and a substantially vertical transom is affixed to the aft edges of the first and second aluminum sheets.

In one embodiment, the boat also has a third bend extending along a majority length of the first sheet parallel to and slightly inboard of the first bend and forming a first reverse chine, and a fourth bend extending along a majority of the length of the second sheet and parallel to and slightly inboard of the second bend and forming a second reverse chine.

In one embodiment, the narrow side decks also comprise a substantially horizontal top sheet and a series of transverse aluminum channel sections supporting the top sheet. The bottom edge of each of the aluminum channel sections is attached to the second edges of the respective first and second sheets and the tops of the respective first and second vertical walls.

In another embodiment, the narrow side decks do not have transverse channels beneath the top sheets. Cable routing pans beneath the top sheets provide conduits for routing cables.

In another embodiment, each of the vertical walls includes an upper portion and a lower portion. During manufacturing of the boat, each of the narrow side decks is leveled by varying the point of attachment of the upper and lower portions of the associated vertical wall.

Figure 1:
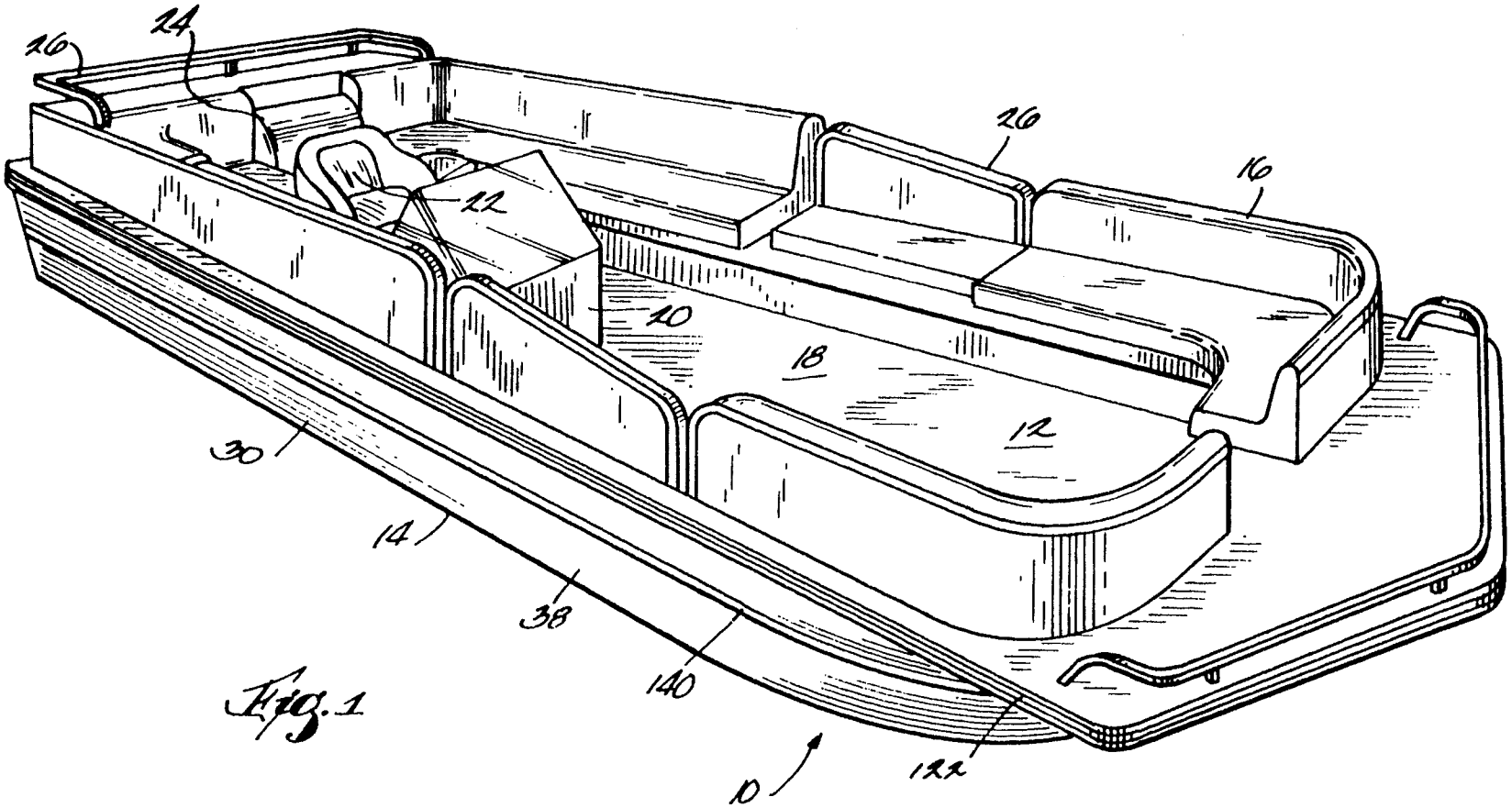
FIG. 1 is a front perspective view of the boat embodying the invention.

Before one embodiment of the invention is explained in detail, it is to be understood that the invention is not limited in its application to the details of construction and arrangements of components set forth in the following description and illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 2:
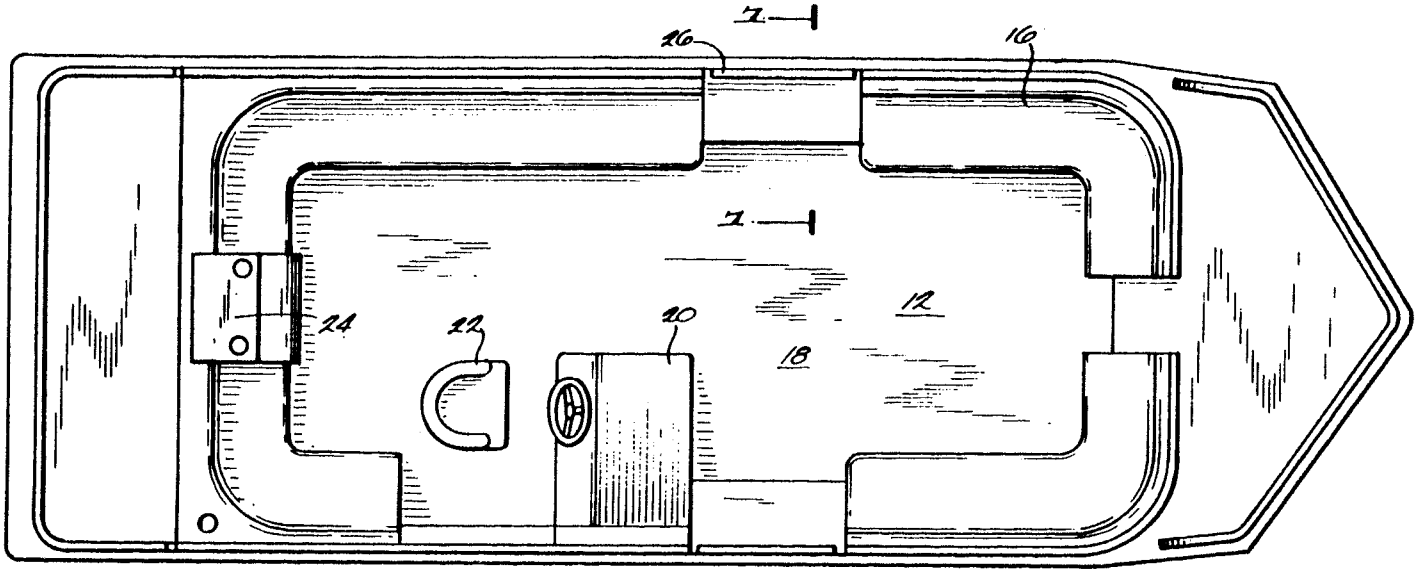
FIG. 2 is a top plan view of a boat embodying the invention.

A boat 10 embodying the invention is illustrated in the drawings. As shown in FIGS. 1 and 2, the boat generally comprises a top seating or deck portion 12 and a hull portion 14. The seating further comprises seats 16 and a recessed, or cockpit, area 18. The boat also has a helm station 20 and a helm chair 22.

In the aft section of the boat, provision is made for a propulsion means. In the boat shown in FIGS. 1 and 2, an inboard/outboard stern drive propulsion mean could be located under the cover 24 and extend out of the transom of the boat. In other embodiments, an outboard motor may be attached to the boat in a suitable notch in the transom.

Figure 3:
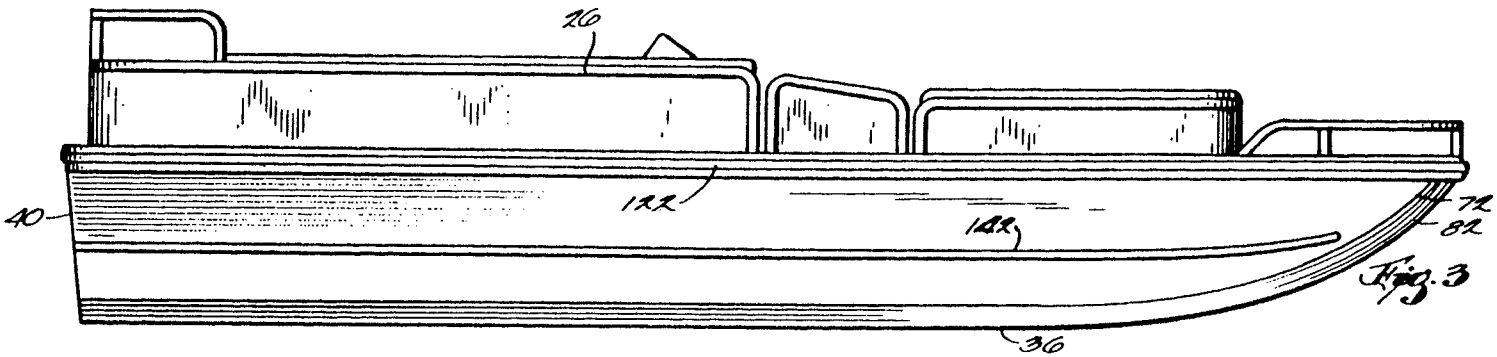
FIG. 3 is a side elevational view of a boat embodying the invention.
Figure 5:
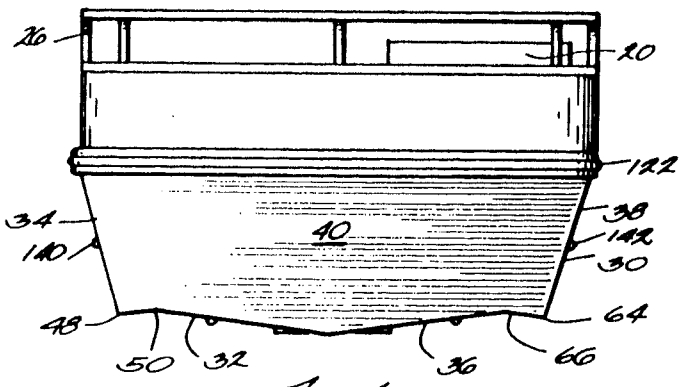
FIG. 5 is a rear elevational view of a boat embodying the invention.
Figures 7, 8, 9, 10:
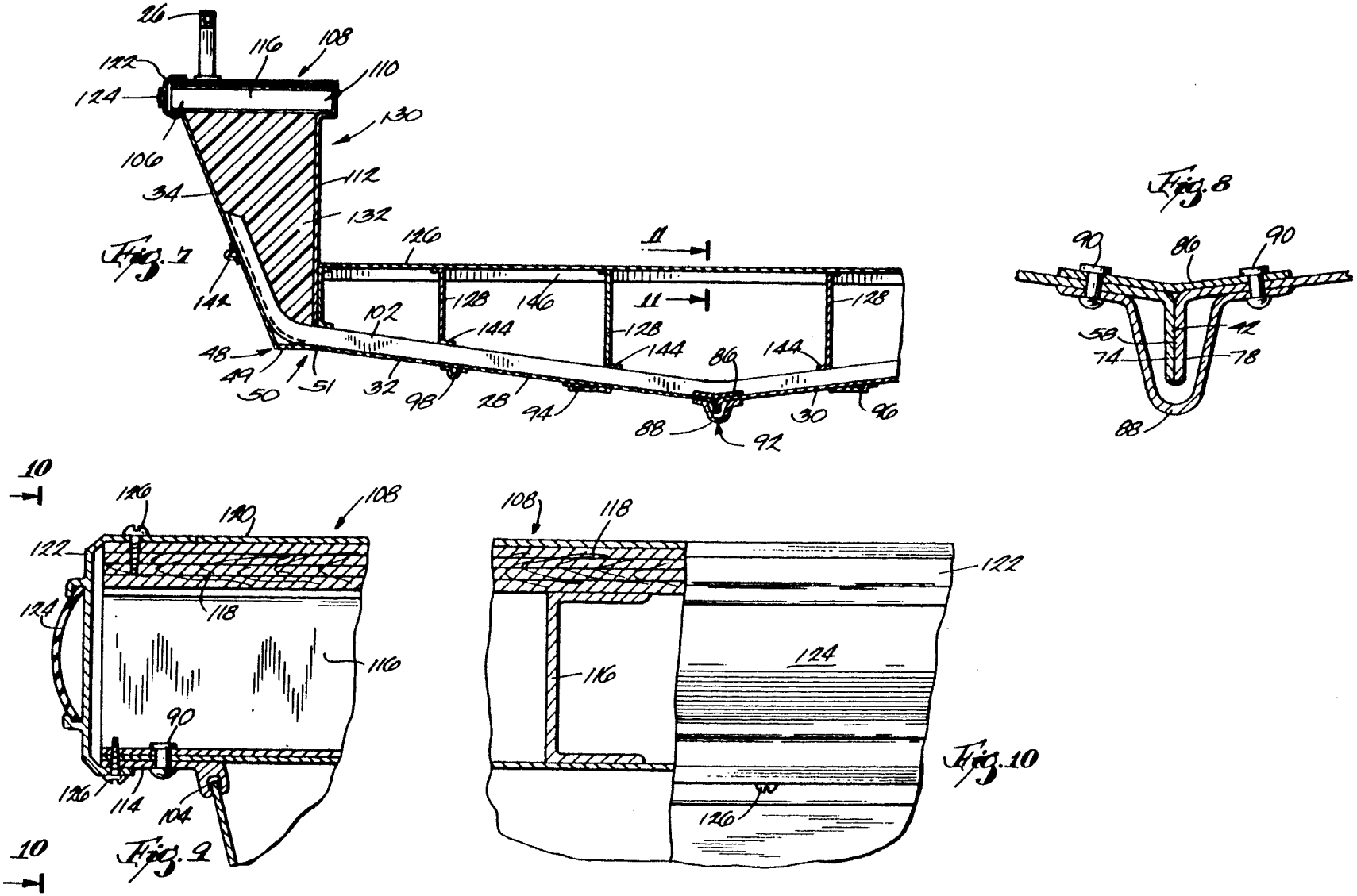
FIG. 7 is a partial cut-away view along line 7—7 of FIG. 2.
FIG. 8 is a detail view of the bottom center of the boat.
FIG. 9 is a detail view of the gunnel construction shown in FIG. 7.
FIG. 10 is a partially cut-away detail view of the gunnel and deck construction of FIG. 9.

It should be appreciated that other seating arrangements can be easily accommodated with this boat construction due to its open deck design. As can be seen in FIGS. 1, 3 and 7, a railing 26 essentially surrounds the backsides of the seats 16. The railing is preferably made of extruded aluminum and can be of various heights depending on the desires of the designer of the boat. Moreover, the railing does not need to be continuous around the entire exterior of the boat, but may have discontinuities and gates at various locations.

The outer skin of the hull portion 14 of the boat 10 is primarily comprised of a port aluminum sheet 28 and starboard aluminum sheet 30. The port aluminum sheet 28 comprises a port hull bottom section 32 and port hull topsides section 34, while the starboard aluminum sheet 30 comprises a starboard hull bottom section 36 and a starboard hull topsides section 38. At the aft end of the boat is a substantially vertical transom 40.

Each of the port 28 and starboard 30 aluminum sheets is cut from a single sheet of aluminum. The port aluminum sheet 28 has a first longitudinal edge 42 and a second longitudinal edge 44. Between the first and second edges 42, and 44, and in the front portion of the port sheet 28, is a slit or cutout 46. This cutout tapers as it extends rearwardly from the front end of the sheet. Aft of the slit 46 and extending approximately parallel between the two longitudinal edges is a first bend 48. The bend 48 acts as the port chine 49 of the boat.

Figure 4:
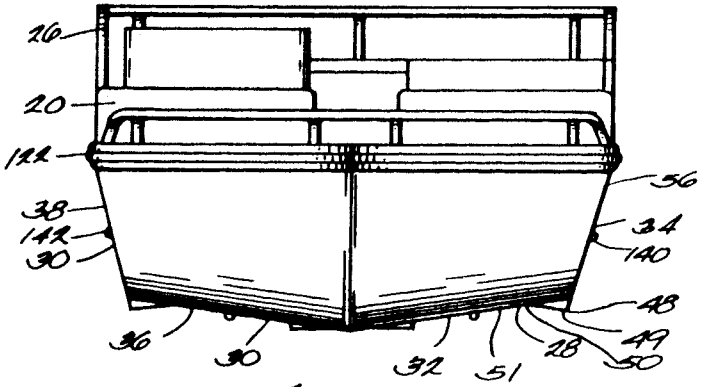
FIG. 4 is a front elevational view of a boat embodying the invention.
Figure 6:
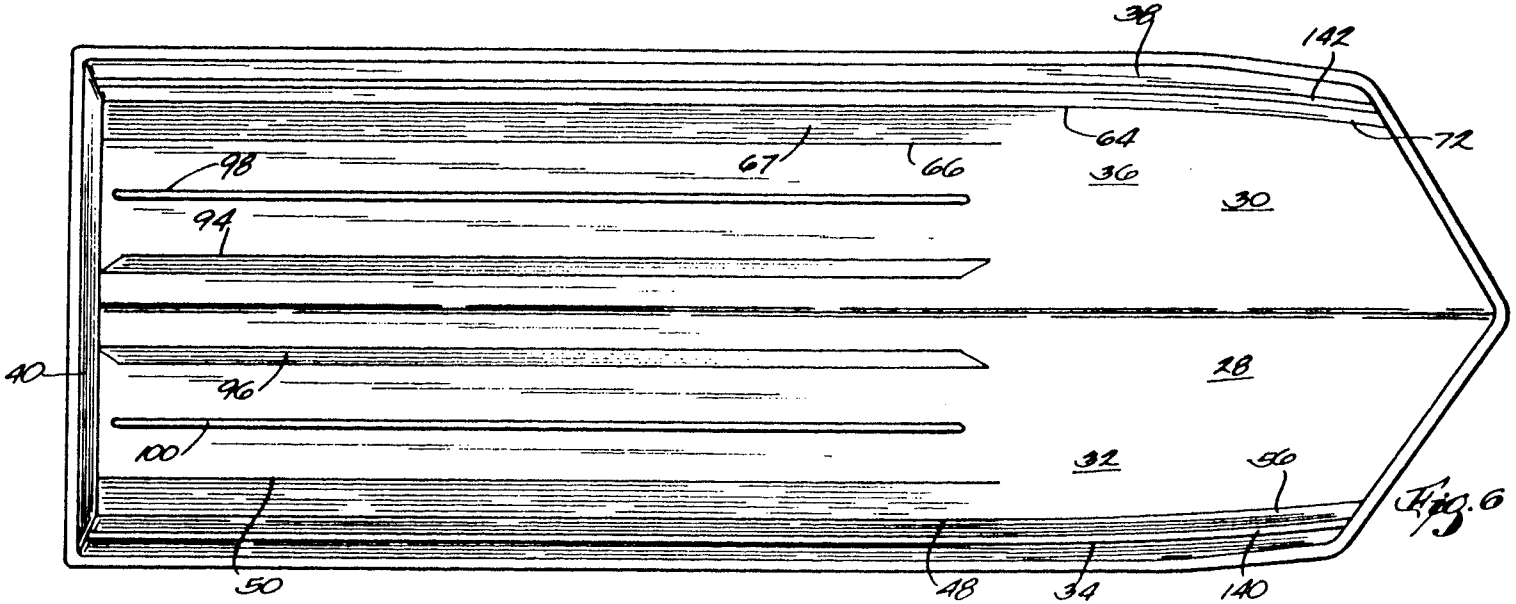
FIG. 6 is a bottom plan view of a boat embodying the invention.

Approximately five inches inboard of the first bend 48 is a second port bend 50 which is only a shallow outward bend, or bend in the opposite direction as the bend 48. The second bend 50 acts to create a port reverse chine 51 in a preferred embodiment of the invention. As can be seen in FIGS. 4 and 7, the port hull bottom section 32 extends upwardly and outwardly at an angle from the first longitudinal edge 42 to the second bend 50. At this point the sheet is bent downwardly to create the port reverse chine 51. At a point approximately five inches outboard of the second bend 50 the first aluminum sheet 28 is bent radically upwardly to create the port topsides section 34 of the boat.

Figure 13:
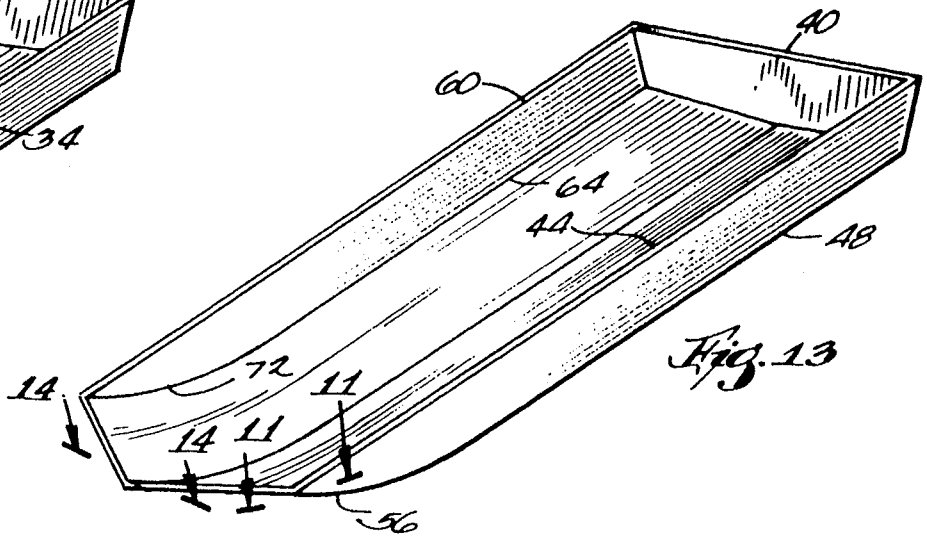
FIG. 13 is a schematic view of a further stage of construction of the boat.
Figure 11:
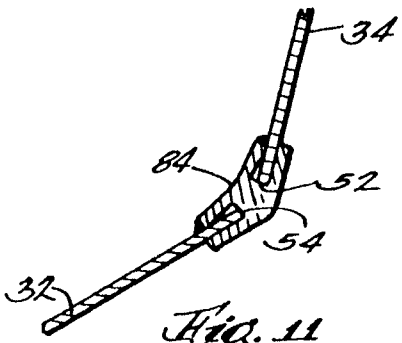
FIG. 11 is a detail of a joint shown in FIG. 13.
Figure 12:
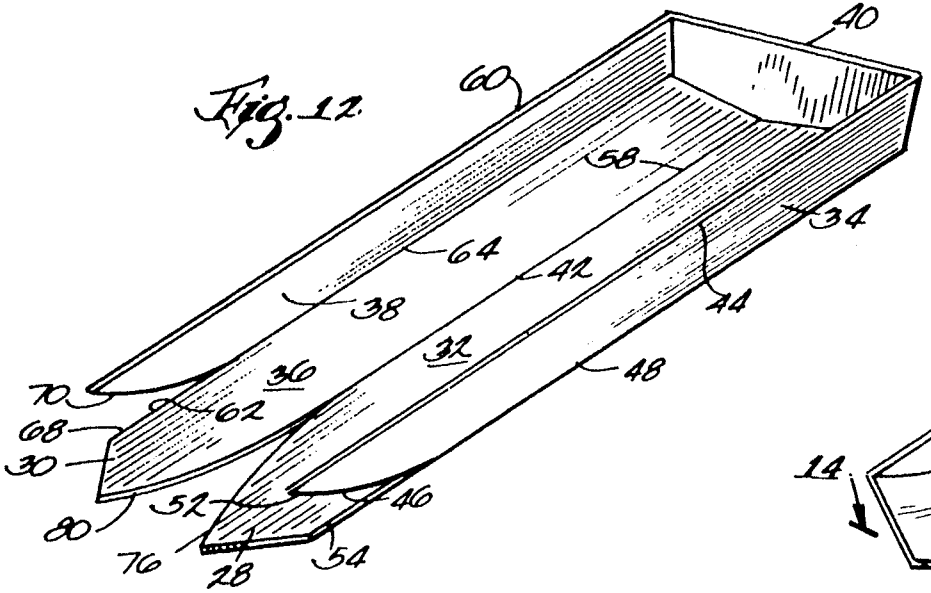
FIG. 12 is a schematic view of an early stage of construction of the boat.

As best seen in FIG. 12, the port aluminum sheet 28 also comprises a pair of edges 52 and 54 on either side of the port slit 46. As best seen in FIG. 13, these edges are welded together to create a port bow corner 56. As best seen in FIG. 11, the edges 52 and 54 may actually be joined together by means of a joint extrusion 84, with the bottom section 32 and the topside section 34 of the port aluminum sheet actually being welded directly to the joint extrusion.

In similar manner, the starboard aluminum sheet 30 has a first longitudinal edge 58 and a second longitudinal edge 60. It also has a starboard slit 62 and a first bend 64 in the starboard sheet 30 aft of the starboard slit 62, with the first starboard bend 64 forming a starboard chine 65 of the boat. In a preferred embodiment, the starboard sheet also comprises a shallow second outward starboard bend 66 approximately five inches inboard from the first bend 64 and creating a starboard reverse chine 67 for the boat.

The starboard aluminum sheet also comprises a pair of edges 68 and 70 along the starboard slit 62. These edges are welded together to create a starboard bow corner 72.

As seen in FIGS. 7 and 8, the first longitudinal edge 42 of the port aluminum sheet 28 has a depending lip 74. This depending lip extends along a majority of the rear portion of the port aluminum sheet 28. The lip 74 ends at a point where a radius 76 is cut into the forward section of the sheet.

Similarly, the first longitudinal edge 58 of the starboard sheet 30 also comprises a depending lip 78 along a majority of its length. This lip terminates at a point where a radius 80 starts in the forward section of the sheet.

Figure 14:
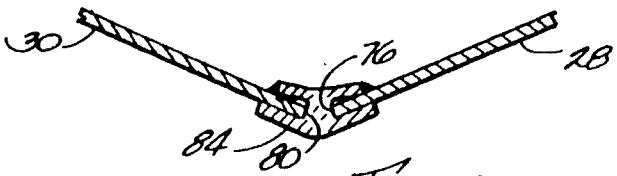
FIG. 14 is a detail of a joint shown in FIG. 13.

The respective first longitudinal edges 42 and 58 of the two aluminum sheets 28 and 30 are attached to form the centerline of the boat. In examining the forward part or bow of the boat first, the first edge 42 of the port sheet along the port radius 76 and the first edge 58 of the starboard sheet along the starboard radius 80 are welded together to cause both of the sheets to bow upwardly to create a curved forward bow section 82. As seen in FIG. 14, in a preferred embodiment, these two edges can be welded together by a joint extrusion 84 with each of the sheets actually being welded to the joint extrusion and the joint extrusion being attached to both of the sheets.

Along a majority of the length of the sheets and aft of the forward radiuses 76 and 80, the two depending lips 74 and 78 are welded together at their outer extremes. In a preferred embodiment, these sheets are further affixed together by a top cover plate 86 and a lower U-plate 88, as seen in FIG. 8. The port and starboard aluminum sheets 28 and 30 are sandwiched between the cover plate 86 and the U-plate 88 and this construction is held in place by a series of rivets 90. The U-plate acts to define a center keel 92 to the boat.

Spaced outboard from the keel on either side is a pair of lifting strakes 94 and 96 which are comprised of long narrow pieces of bent aluminum also riveted to the bottom of the boat. Outboard of the lifting strakes is a pair of longitudinal outboard strengthening ribs or keels 98 and 100. A pair of spray rails 140 and 142 also extend along and are affixed to the outside of the topsides of the boat by means of a series of rivets. The center keel, lifting strakes, longitudinal strengthening ribs or keels and spray rails all terminate at a point immediately aft of the curved bow section. The center keel 92, the lifting strakes 94 and 96, the strengthening ribs 98 and 100, and the spray rails 140 and 142 act to increase the longitudinal stability and rigidity of the boat.

Running transversely immediately above or inside and affixed to the aluminum sheets 28 and 30 by rivets are a plurality of transverse strengthening ribs 102 as seen in FIG. 7. These ribs extend across the entire bottom of the port hull bottom section 32 and the starboard hull bottom section 36 and part-way up the port topside section 34 and the starboard topside section 38. They are spaced apart at a distance of approximately fourteen inches. The ribs also enhance the rigidity of the resulting hull.

From this point on only the port side construction of the boat will be explained in detail. It is to be understood that the starboard side is constructed as a mirror image to the port side.

The port hull topside section 34 has an outer longitudinal edge 104. Situated generally above and affixed to this edge is the outboard end portion 106 of the narrow side deck 108. The narrow side deck 108 extends inwardly for a short distance and terminates in an inboard end portion 110. The inboard end portion 110 is supported by a vertical wall 112, which is upwardly standing and riveted to the tops of the transverse ribs 102 immediately above the bottom hull section 32 at a location inboard of the second bend 50. This construction extends along a majority of the length of the port side of the boat 10.

As can be seen in FIG. 7, a relatively stiff box section 130 is created along the port side of the boat. Two sides of this box section are formed by the bottom and topside sections 32 and 34 of the port aluminum sheet 28 along with the ribs, separated by the angle forming the chine 51. The box section further comprises the narrow side deck 108 along its top and the vertical wall 112 along its inboard side. The box section 130 can be further strengthened by injecting a relatively stiff urethane foam 132 into the space defined by these walls and allowing the foam to harden and fill in the interstices. By this construction, the boat has excellent structural rigidity and light weight.

As seen in FIGS. 7 and 9, in a preferred embodiment, the outboard end portion of the narrow deck is supported on the outer edge 104 of the topside section 34 of the aluminum sheet 28 by means of a deck support extrusion 114 which captures the longitudinal edge 104 and is riveted to a series of transverse channels 116 by a series of rivets 90. Supported at the top of the series of transverse channels 116 is a sheet of plywood 118 and above the plywood is preferably and indoor/outdoor carpet or vinyl covering 120. Along the outer edge of the outboard end portion of the narrow deck is a rub rail 122, preferably having a resilient insert 124. The rub rail 122 is attached to the upper and lower edges of the narrow deck and the deck support extrusion 114 by a series of screws 126.

In a similar manner (not shown), the vertical wall 112 supports the inboard end portion 110 of the narrow deck 108 by being captured in a deck support extrusion which is also riveted to the transverse channels 116. The bottom portion of the vertical wall 112 is bent at a right angle to form a small lip which is riveted directly to the transverse ribs 102. Sitting above and supported by the narrow deck is the railing 26.

Inboard of the vertical wall 112 and below the narrow deck 108 is the cockpit floor 126. The cockpit floor 126 is supported by a series of longitudinal supports 128 spaced evenly from the port vertical wall 112 to the starboard vertical wall (not shown). Each support 128 is riveted to the tops of the ribs 102 by means of lower lips 144 and is also riveted to the bottom of the cockpit floor. Also supporting the cockpit floor 126 are a series of transverse channels 146 evenly spaced along the length of the cockpit. The supports 128 have therein notches 147 (see FIG. 15) receiving the channels 146. The transverse channels 146 are welded to the vertical walls 112 and to the longitudinal supports 128 to create a lattice work throughout the lower middle section of the boat to also enhance the rigidity of the boat.

In a preferred embodiment, in the aft end of the boat, the vertical wall 112 and the bottom section 32 and topside section 34 of the port aluminum sheet are all attached to the transom in order to give additional support to the boat.

As stated earlier, although only the port narrow side deck and vertical wall are shown, it can be appreciated that there is a similar construction along the starboard side of the boat in order to keep the boat balanced and give it additional support.

Figure 15:
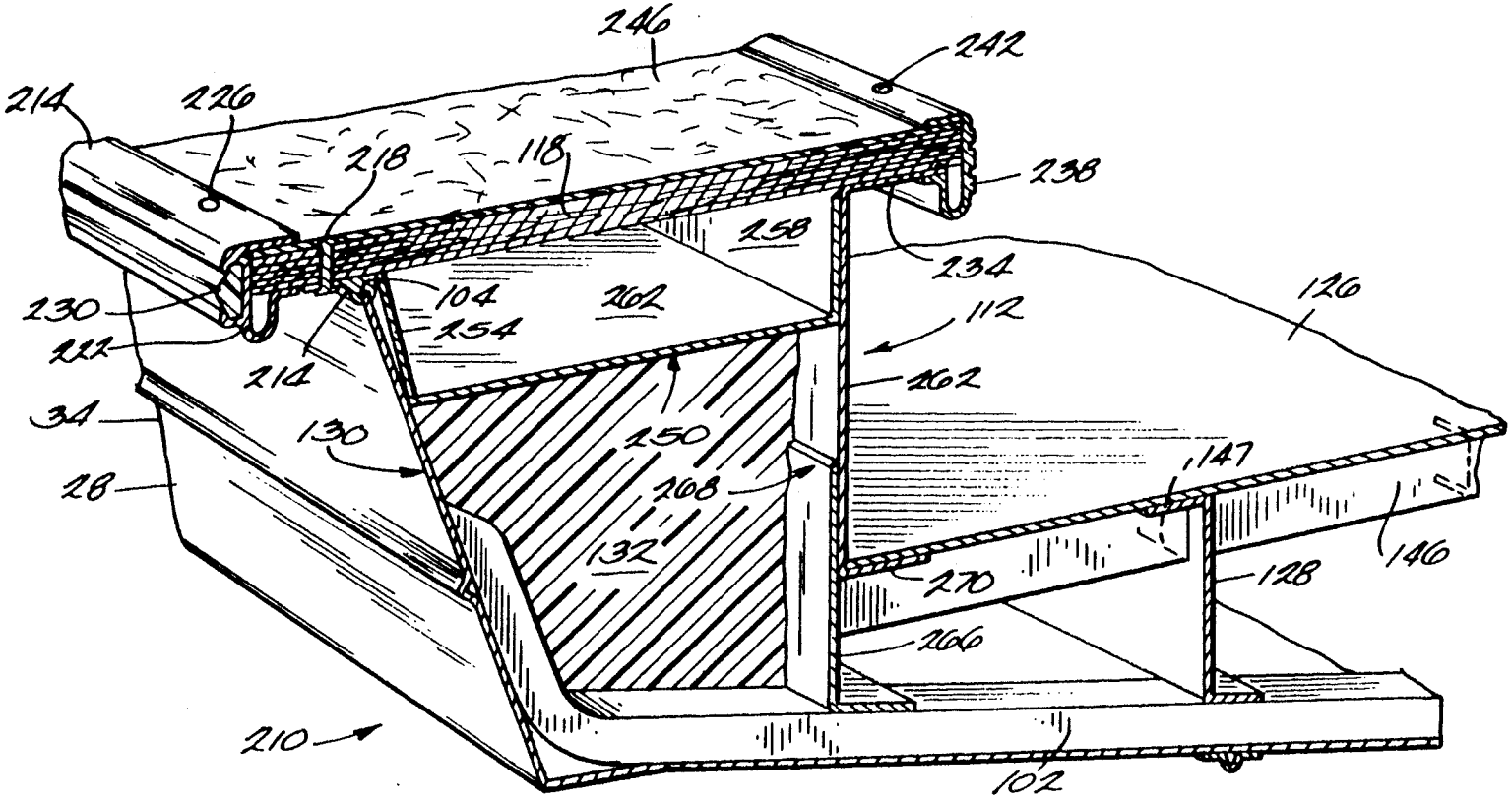
FIG. 15 is a partial, sectional perspective view of a boat that is an alternative embodiment of the invention.

A boat 210 that is an alternative embodiment of the invention is illustrated in FIG. 15. Except as described below, the boat 210 is substantially identical to the boat 10, and common elements have been given the same reference numerals.

The boat 210 does not include the transverse channels 116 of the boat 10. Instead, in the boat 210, the top sheet of plywood 118 is supported by the outer longitudinal edge 104 of the port topside section 34 and by the top of the vertical wall 112 without transverse support beneath the top sheet 118. As shown in FIG. 15, the outboard end portion of the plywood sheet 118 is supported by a gunwale extrusion 214 that captures the longitudinal edge 104 and that is riveted to the plywood 118 by a series of rivets 218. An outer trim band extrusion 222 is secured to the outboard end of the plywood sheet 118 by a series of screws 226. A resilient insert 230 serving as a rub rail is carried by the extrusion 222. The inboard end portion of the plywood sheet 118 sits on top of a flange 234 extending inwardly from the upper end of the vertical wall 112. An inner trim band extrusion 238 is secured to the inboard end of the sheet 118 by a series of screws 242. The extrusion 238 extends over the flange 234. Preferably, the plywood sheet 118 is covered by carpeting 246 captured beneath the extrusions 222 and 238.

In the boat 10, cables are routed through the box section 130 through holes (not shown) drilled in the transverse channels 116. In the boat 210, a passageway for cables is provided by a cable routing pan 250 which extends longitudinally between the aluminum sheet 28 and the vertical wall 112 and which is suspended beneath the plywood sheet 118. More particularly, the cable routing pan 250 is generally U-shaped in cross section and includes inboard and outboard vertical portions 254 and 258 and a horizontal portion 262. The upper end of the outboard vertical portion 254 is welded to the extrusion 214 and the upper end of the inboard portion 258 is welded to the vertical wall 112. The foam 132 fills the space between the aluminum sheet 28 and the vertical wall 112 and below the cable routing pan 250.

The boat 210 also differs from the boat 10 in that the vertical wall 112 of the boat 210 includes separate upper and lower portions 262 and 266 welded together. The lower end of the lower wall portion 266 is fixed to the transverse ribs 102. The upper end of the upper portion 262 has thereon the flange 234 supporting the inboard end of the plywood sheet 118, and the lower end of the upper portion 262 is welded to the lower portion 266 adjacent the upper end thereof. The lower end of the upper portion 262 includes an inwardly extending flange 270 having an upper surface supporting the cockpit floor 126.

The separate upper and lower portions 262 and 266 of the vertical wall 112 facilitate leveling of the narrow side deck 108 during manufacturing of the boat 210. After the outboard end of the side deck 108 is connected to the aluminum sheet 28 and the inboard end of the side deck 108 is connected to the wall upper portion 262, the side deck 108 is leveled by moving the upper wall portion 262 up or down relative to the lower wall portion 266 before welding the wall portions 262 and 266 together.

Various features and advantages of the invention are set forth in the following claims.

I claim:

1. A recreational boat having a first side and a second side comprising a first sheet of aluminum having first and second longitudinal edges and a first bend extending along a majority of the length of said first sheet between said first and second longitudinal edges of said first sheet, said first bend forming a first chine of said boat, a second sheet of aluminum also having first and second longitudinal edges and a second bend extending along a majority of the length of said second sheet between said first and second longitudinal edges of said second sheet, said second bend forming a second chine of said boat, a plurality of transverse ribs, each of said ribs affixed to said first and said second sheets, first and second narrow side decks with each of said narrow side decks having an outer edge portion and an inner edge portion, first and second inboard vertical walls with each of said vertical walls having a top and bottom, said first sheet and said second sheet affixed along said respective first longitudinal edges to form a centerline of said boat, said first narrow deck outer edge portion affixed to said second longitudinal edge of said first aluminum sheet and said first narrow deck inner edge portion affixed to said top of said first vertical wall, said second narrow deck outer edge portion affixed to said second longitudinal edge of said second aluminum sheet and said second narrow deck inner edge portion affixed to said top of said second vertical wall, and said bottoms of said first and second vertical walls respectively affixed to said transverse ribs inboard of said respective first and second bends.

2. The boat of claim 1 wherein said first sheet, said first narrow side deck and said first vertical wall comprise a first box section along the one side of said boat and wherein said second sheet, said second narrow deck and said second vertical wall comprise a second box section along the second side of the boat and said first and second box sections enhance the rigidity of the boat.

3. The boat of claim 2 wherein said first longitudinal edge of said first sheet has a first depending lip along a majority of its length, wherein said first longitudinal edge of said second sheet has a second depending lip along a majority of its length and wherein said first sheet and said second sheet are affixed along said first and said second lips to form a keel of the boat.

4. The boat of claim 3 also having a cover plate, substantially semi-circular in cross section, depending from said aluminum sheets near said connection of said sheets at said first and second lips.

5. The boat of claim 1 wherein said first sheet also comprises a first longitudinal slit at its forward portion, said slit being between said first and second longitudinal edges and forward of said first bend.

6. The boat of claim 5 wherein said first sheet has a pair of edges along said first slit and said edges are welded together.

7. The boat of claim 1 wherein each of said ribs is affixed to said first sheet both inboard and outboard of said first bend and affixed to said second sheet both inboard and outboard of said second bend.

8. The boat of claim 1 also having a cockpit floor extending between said first and second vertical walls and below said first and said second narrow decks.

9. The boat of claim 1 also having foam flotation material substantially filling the space outboard of said first and second vertical walls and below said first and second narrow decks.

10. The boat of claim 8 also having transverse cockpit floor supports and longitudinal cockpit floor supports and wherein said transverse floor supports are attached to said vertical walls and to said longitudinal floor supports.

11. The boat of claim 1 also having a substantially vertical transom member and wherein said first and said second aluminum sheets also have aft edges and said transom member is affixed to said aft edges of said first and second aluminum sheets.

12. The boat of claim 1 also having a third bend extending along a majority of the length of said first sheet parallel to and slightly inboard of said first bend and forming a first reverse chine, and a fourth bend extending along a majority of the length of said second sheet and parallel to and slightly inboard of said second bend and forming a second reverse chine.

13. The boat of claim 2 wherein said narrow side decks also comprise a substantially horizontal top sheet and a series of transverse aluminum channel sections, the bottom edge of each of said aluminum channel sections attached to said second edges of said respective first and second sheets and said tops of said respective first and second vertical walls.

14. The boat of claim 2 also having seats affixed atop a major portion of said first and second narrow side decks.

15. The boat of claim 1 wherein each of said narrow side decks includes a substantially horizontal top sheet supported by said second edge of the associated one of said first and second sheets and by said top of the associated one of said first and second vertical walls.

16. The boat of claim 15 wherein each of said narrow side decks includes transverse supports beneath said top sheet.

17. The boat of claim 16 wherein said transverse supports include a series of transverse aluminum channel sections, the bottom edge of each of said aluminum channel sections being attached to said second edge of the associated one of said first and second sheets and to said top of the associated one of said first and second vertical walls, said top sheet being supported by said transverse aluminum channel sections.

18. The boat of claim 1 and further comprising a cable routing pan extending longitudinally between said first sheet and said first vertical wall and being suspended beneath said top sheet of said first narrow side deck.

19. The boat of claim 1 wherein said first vertical wall includes a lower portion fixed to said transverse ribs, and an upper portion fixed to said lower portion and to said inner edge portion of said first narrow side deck, and wherein said second vertical wall includes a lower portion fixed to said transverse ribs, and an upper portion fixed to said lower portion of said second vertical wall and to said inner edge portion of said second narrow side deck.

20. The boat of claim 19 and further comprising transverse floor supports extending between and fixed to said upper portions of said first and second vertical walls, and a cockpit floor which extends between said first and second vertical walls and below said narrow side decks and which is supported by said transverse floor supports.

21. The boat of claim 20 wherein said upper portion of each of said vertical walls has a lower end including an inwardly extending flange, said flange having an upper surface supporting said cockpit floor.

22. The boat of claim 19 wherein, during manufacturing of said boat, each of said narrow side decks is leveled by varying the point of attachment of the upper and lower portions of the associated vertical wall.

23. A boat having first and second sides and comprising a hull outer skin having a first longitudinal edge on one side of said boat and a second longitudinal edge on the other side of said boat, first and second inboard vertical walls each having a top and a bottom, first and second narrow side decks each having an outer edge portion and an inner edge portion, said first narrow deck outer edge portion being affixed to said first longitudinal edge of said outer skin and said first narrow deck inner edge portion being affixed to said top of said first vertical wall, and said second narrow deck outer edge portion being affixed to said second longitudinal edge of said outer skin and said second narrow deck inner edge portion being affixed to said top of said second vertical wall, a cockpit floor which extends between said vertical walls and above said bottoms thereof, and a cable routing pan extending longitudinally between said outer skin and said first vertical wall and being suspended beneath said first narrow side deck.

24. A boat having first and second sides an comprising a hull outer skin having a first longitudinal edge on one side of said boat and a second longitudinal edge on the other side of said boat, first and second inboard vertical walls each including an upper end and a lower end first and second narrow side decks each having an outer edge portion and an inner edge portion, said first narrow deck outer edge portion being affixed to said first longitudinal edge of said outer skin and said first narrow deck inner edge portion being affixed to said upper end of said first vertical wall, said second narrow deck outer edge portion being affixed to said second longitudinal edge of said outer skin and said second narrow deck inner edge portion being affixed to said upper end of second vertical wall, and a cockpit floor which extends between said first and second vertical walls, below said narrow side decks, and above said lower ends of said vertical walls.

25. The boat of claim 24 wherein, during manufacturing of said boat, each of said narrow side decks is leveled by varying the point of attachment of the upper and lower portions of the associated vertical wall.

26. A boat in accordance with claim 24 wherein each of said inboard vertical walls includes an upper portion including a lower part and said upper end, and a lower portion including an upper part located above said lower part of said upper portion and said lower end.

27. The boat of claim 26 wherein said lower end of said upper portion of each of said vertical walls includes an inwardly extending flange, said flange having an upper surface supporting said cockpit floor.

28. A boat comprising a first sheet of material having first and second longitudinal edges and a first bend extending along a majority of the length of said first sheet between said first and second longitudinal edges of said first sheet, said first bend dividing said first sheet into a hull topside section and a hull bottom section, a second sheet of material having first and second longitudinal edges and a second bend extending along a majority of the length of said second sheet between said first and second longitudinal edges of said second sheet, said second bend dividing said second sheet into a hull topside section and a hull bottom section, first and second narrow side decks with each of said narrow side decks having an outer edge portion and an inner edge portion, first and second inboard vertical walls with each of said vertical walls having a top and bottom, said first sheet and said second sheet affixed along said respective first longitudinal edges to form a centerline of said boat, said first narrow deck outer edge portion affixed to said second longitudinal edge of said first sheet and said first narrow deck inner edge portion affixed to said top of said first vertical wall, said second narrow deck outer edge portion affixed to said second longitudinal edge of said second sheet and said second narrow deck inner edge portion affixed to said top of said second vertical wall, and said bottoms of said first and second vertical walls respectively supported by said first and second sheets inboard of said respective first and second bends.

* * * * *